US008787793B2

(12) United States Patent
Toso et al.

(10) Patent No.: US 8,787,793 B2
(45) Date of Patent: Jul. 22, 2014

(54) IMAGE CARRIER DRIVER AND IMAGE FORMING APPARATUS WITH DAMPER CONFIGURED TO ATTENUATE OSCILLATION ASSOCIATED WITH POWER TRANSMISSION

(75) Inventors: Yoshiyuki Toso, Toyokawa (JP); Shoichi Yoshikawa, Okazaki (JP); Tadayasu Sekioka, Toyohashi (JP); Noboru Oomoto, Toyokawa (JP); Takashi Fujiwara, Toyohashi (JP); Naoki Miyagawa, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/416,110

(22) Filed: Mar. 9, 2012

(65) Prior Publication Data

US 2012/0251178 A1 Oct. 4, 2012

(30) Foreign Application Priority Data

Mar. 31, 2011 (JP) ..... 2011-077558

(51) Int. Cl.
*G03G 15/02* (2006.01)
*G03G 15/00* (2006.01)

(52) U.S. Cl.
USPC ..... 399/116; 399/167

(58) Field of Classification Search
USPC ..... 399/116, 117, 167
See application file for complete search history.

(56) References Cited

U.S. PATENT DOCUMENTS

| | | | | |
|---|---|---|---|---|
| 5,323,211 | A | 6/1994 | Fujii et al. | |
| 5,420,664 | A | 5/1995 | Miwa et al. | |
| 6,044,242 | A | 3/2000 | Kakiwaki et al. | |
| 6,097,918 | A | 8/2000 | Inoue et al. | |
| 2002/0001483 | A1 | 1/2002 | Makino et al. | |
| 2007/0189805 | A1 * | 8/2007 | Takigawa | 399/111 |

FOREIGN PATENT DOCUMENTS

| | | |
|---|---|---|
| JP | 05-045989 | 2/1993 |
| JP | 05-72836 | 3/1993 |
| JP | 06-133122 | 5/1994 |
| JP | 06-264970 A | 9/1994 |

(Continued)

OTHER PUBLICATIONS

Notice of Decision to Grant Patent issued on Oct. 2, 2013 by the Japanese Patent Office in corresponding Japanese Patent Application No. 2011-077558, and English-language translation thereof (6 pages).

(Continued)

*Primary Examiner* — Billy Lactaoen
(74) *Attorney, Agent, or Firm* — Buchanan Ingersoll & Rooney PC

(57) ABSTRACT

An image carrier driver includes an image carrier, a first power transmitter, a rotator, a second power transmitter, and a damper. The image carrier is configured to rotate by power generated by a driving source. The first power transmitter is configured to transmit the power from the driving source to the image carrier. The rotator is disposed further downstream than the image carrier in a flow of power transmission. The second power transmitter is configured to transmit the power from the image carrier to the rotator. The damper is disposed in the image carrier and is configured to attenuate an oscillation associated with the power transmission and transmitted to the image carrier.

16 Claims, 6 Drawing Sheets

(56) References Cited

FOREIGN PATENT DOCUMENTS

| | | | | | |
|---|---|---|---|---|---|
| JP | 07-140744 | A | | 6/1995 | |
| JP | 07-140841 | | | 6/1995 | |
| JP | 07140841 | A | * | 6/1995 | ..... G03G 21/00 |
| JP | 08-286588 | A | | 11/1996 | |
| JP | 11-052764 | A | | 2/1999 | |
| JP | 2002-174932 | A | | 6/2002 | |
| JP | 2002-268459 | A | | 9/2002 | |
| JP | 2002-351174 | A | | 12/2002 | |
| JP | 2003-036007 | | | 2/2003 | |
| JP | 2003-057998 | | | 2/2003 | |
| JP | 2003-254389 | A | | 9/2003 | |
| JP | 2004-037689 | A | | 2/2004 | |
| JP | 2005-249109 | A | | 9/2005 | |
| JP | 2005-345906 | A | | 12/2005 | |
| JP | 2006-084543 | | | 3/2006 | |
| JP | 2007-047613 | A | | 2/2007 | |
| JP | 2010-055055 | A | | 3/2010 | |

OTHER PUBLICATIONS

Japanese Office Action dated Apr. 26, 2013 and issued by the Japan Patent Office in corresponding Japanese Patent Application No. 2011-077558, and English translation thereof.

* cited by examiner

IMAGE CARRIER DRIVER AND IMAGE FORMING APPARATUS WITH DAMPER CONFIGURED TO ATTENUATE OSCILLATION ASSOCIATED WITH POWER TRANSMISSION

CROSS-REFERENCE TO RELATED APPLICATIONS

The present application claims priority under 35 U.S.C. §119 to Japanese Patent Application No. 2011-077558, filed Mar. 31, 2011. The contents of this application are incorporated herein by reference in their entirety.

BACKGROUND OF THE INVENTION

1. Field of the Invention

The present invention relates to an image carrier driver and an image forming apparatus.

2. Discussion of the Background

Electrographic image forming apparatuses obtain images by forming an electrostatic latent image on the surface of a rotating photoreceptor drum, visualizing the electrostatic latent image into a toner image on a developer, and electrostatically transferring the toner image onto a recording medium.

Japanese Unexamined Patent Application Publication No. 2002-174932 discloses an image forming apparatus including a photoreceptor drum drivingly rotated by power generated by a driving motor, and a gear train to transmit the power from the driving motor to the photoreceptor drum. Between the gears of the gear train, an anti-oscillation rubber material is disposed to attenuate oscillations transmittable to the photoreceptor.

SUMMARY OF THE INVENTION

According to one aspect of the present invention, an image carrier driver includes an image carrier, a first power transmitter, a rotator, a second power transmitter, and a damper. The image carrier is configured to rotate by power generated by a driving source. The first power transmitter is configured to transmit the power from the driving source to the image carrier. The rotator is disposed further downstream than the image carrier in a flow of power transmission. The second power transmitter is configured to transmit the power from the image carrier to the rotator. The damper is disposed in the image carrier and is configured to attenuate an oscillation associated with the power transmission and transmitted to the image carrier.

According to another aspect of the present invention, an image forming apparatus includes a power source and an image carrier driver. The image carrier driver includes an image carrier, a first power transmitter, a rotator, a second power transmitter, and a damper. The image carrier is configured to rotate by power generated by the driving source. The first power transmitter is configured to transmit the power from the driving source to the image carrier. The rotator is disposed further downstream than the image carrier in a flow of power transmission. The second power transmitter is configured to transmit the power from the image carrier to the rotator. The damper is disposed in the image carrier and is configured to attenuate an oscillation associated with the power transmission and transmitted to the image carrier.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
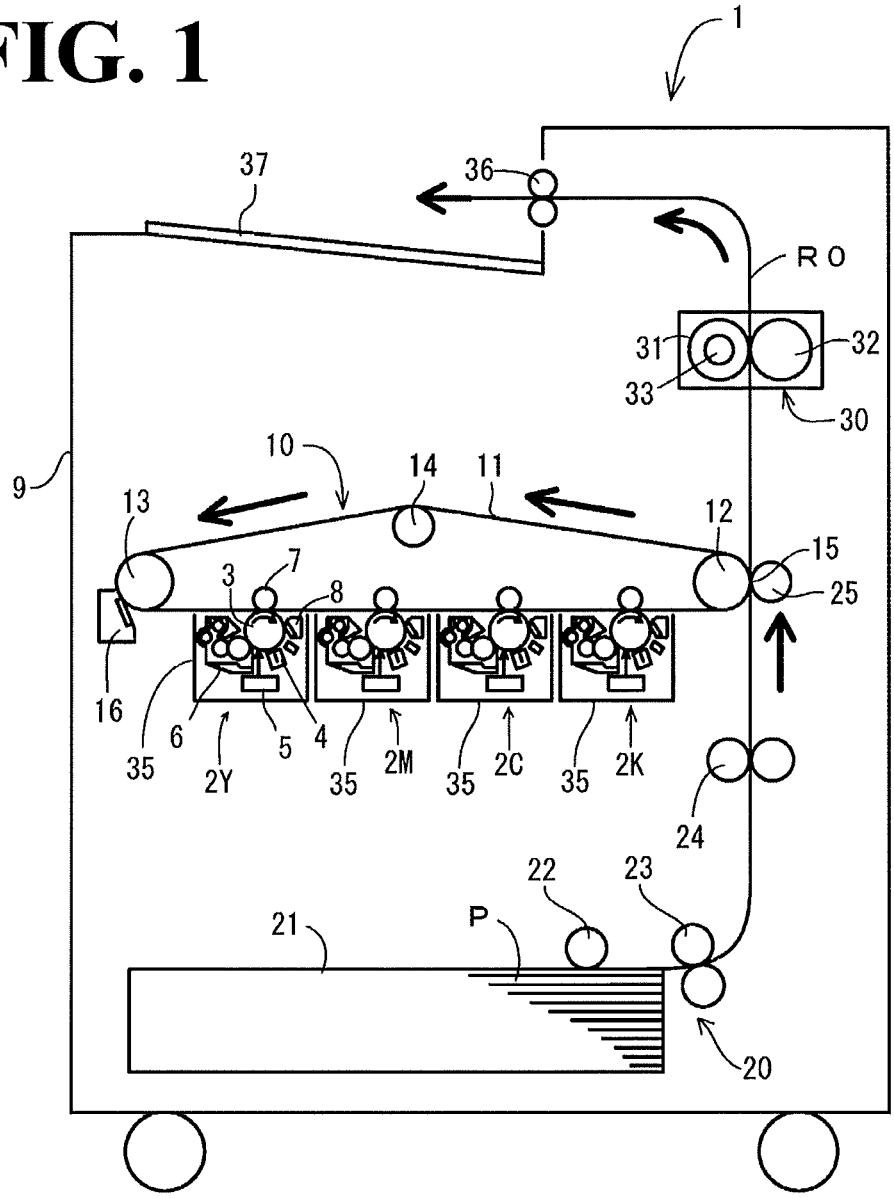
FIG. 1 is a schematic diagram illustrating a printer.

The embodiments will now be described with reference to the accompanying drawings, wherein like reference numerals designate corresponding or identical elements throughout the various drawings.

In the following embodiments, a tandem color digital printer (hereinafter referred to as a printer) will be described for exemplary purposes. In the following description, terms indicating specific directions and positions (for example, "left and right" and "upper and lower") are used where necessary. In this respect, the direction perpendicular to the paper plane of FIG. 1 is defined as front view. The terms are used for the sake of description and will not limit the technical scope of the present invention.

1. Overview of Printer

An overview of a printer 1 will be first described by referring to FIG. 1. The printer 1 includes an image forming unit 10, a feeder 20, and a fixing unit 30. The image forming unit 10, the feeder 20, and the fixing unit 30 are disposed in a casing 9 of the printer 1. The printer 1 is coupled to a network such as a LAN so that upon receipt of a print command from an external terminal (not shown), the printer 1 executes printing jobs based on the command, which is not elaborated in the drawings.

The image forming unit 10 transfers toner images on photoreceptor drums 3, which are exemplary image carriers, to a sheet of recording media P. The image forming unit 10 includes an intermediate transfer belt 11 and a total of four image forming units 2 respectively corresponding to colors of yellow (Y), magenta (M), cyan (C), and black (K). Below and along the intermediate transfer belt 11, the four image forming units 2 of yellow, magenta, cyan, and black are arranged in this order starting on the left side of FIG. 1. Each image forming unit 2 includes a photoreceptor drum 3 that drivingly rotates in the clockwise direction as seen in FIG. 1. Around the photoreceptor drum 3, a charger 4, an exposing unit 5, a developer 6, a primary transfer roller 7, and a photoreceptor cleaner 8 are arranged in this order in the rotation direction of the photoreceptor drum 3. For the sake of description, in FIG. 1, the image forming units 2 are respectively labeled with symbols Y, M, C, and K in accordance with reproduced colors. Also for simplicity, the components, such as the photoreceptor drum 3, of the image forming unit 2Y, for yellow, are labeled with reference numerals 3 to 8, while the components of the other image forming units, 2M to 2K, are not labeled with reference numerals 3 to 8.

The intermediate transfer belt 11 is wound across a driving roller 12, a driven roller 13, and a tension roller 14. The intermediate transfer belt 11 drivingly rotates in the anti-clockwise direction as seen in FIG. 1. A secondary transfer roller 25, which is a component of the feeder 20, is disposed on the outer peripheral side of a portion of the intermediate transfer belt 11 wound around the driving roller 12. The intermediate transfer belt 11 and the secondary transfer roller 25 define, at the portion of their contact, a secondary transfer portion 15. A transfer belt cleaner 16 is disposed on the outer peripheral side of a portion of the intermediate transfer belt 11 wound around the driven roller 13. The transfer belt cleaner 16 removes un-transferred toner on the intermediate transfer belt 11.

The feeder 20 includes a sheet feed cassette 21, a sheet feed roller 22, a pair of separation rollers 23, a pair of resist rollers 24, and the secondary transfer roller 25. The sheet feed cassette 21 accommodates recording media P. The sheet feed roller 22 feeds the recording media P in the sheet feed cassette 21 one at a time to a conveyance path R0. The pair of separation rollers 23 separate the picked sheets of recording media P into individual sheets. The pair of resist rollers 24 determine the timing at which to feed the individual sheet of recording media P to the secondary transfer portion 15. The recording media P in the sheet feed cassette 21 are sent to the conveyance path R0 one at a time starting from the uppermost piece by the rotation of the sheet feed roller 22 and the pair of separation rollers 23.

The fixing unit 30 includes a fixing roller 31 and a pressure roller 32. The fixing roller 31 incorporates a fixing heater 33 such as a halogen lamp. The pressure roller 32 is opposite the fixing roller 31. The fixing roller 31 and the pressure roller 32 define, at the portion of their contact, a fixing position. A controller (not shown) controls power to the fixing heater 33 to keep the fixing heater 33 at a temperature necessary for the fixing. A pair of discharging rollers 36 that discharge the printed recording medium P are disposed further downstream than the fixing unit 30 in the path of conveyance. At an upper portion of the printer 1, a discharge tray 37 dedicated to the pair of discharging rollers 36 is disposed. The conveyance path R0 at its distal end extends toward the pair of discharging rollers 36. The printed recording medium P is discharged onto the discharge tray 37 by the rotation of the pair of discharging rollers 36.

A sheet of recording media P is printed in the following manner. In each of the image forming units 2Y to 2K, the photoreceptor drum 3 is cleaned by the photoreceptor cleaner 8 and uniformly charged by the charger 4. The charged photoreceptor drum 3 is irradiated with light from the exposing unit 5, thereby forming an electrostatic latent image on the surface of the photoreceptor drum 3. The electrostatic latent image is reverse-developed using toner from the developer 6 and visualized into a toner image of the corresponding color. The toner images of yellow, magenta, cyan, and black on the photoreceptor drums 3 are primary transferred in the order set forth to the intermediate transfer belt 11 on the primary transfer rollers 7, so that the toner images are superimposed onto each other on the intermediate transfer belt 11.

Meanwhile, a sheet of recording media P is conveyed to the secondary transfer portion 15 by the driving rotation of the pair of resist rollers 24 at the timing when the color toner images move to the secondary transfer portion 15 by the driving rotation of the intermediate transfer belt 11. The superimposed toner images of the four colors are collectively secondary transferred onto one surface of the sheet of recording media P that is passing through the secondary transfer portion 15. After the secondary transfer, the intermediate transfer belt 11 is cleaned by the transfer belt cleaner 16. The sheet of recording media P past the secondary transfer portion 15 with an unsecured toner image on one surface is heated and pressed while passing through the fixing unit 30. Thus, the unsecured toner image is fixed on the sheet of recording media P. The sheet of recording media P after the fixing (printing) is discharged onto the discharge tray 37 by the driving rotation of the pair of discharging rollers 36.

For example, the developer 6 of each image forming unit 2, the intermediate transfer belt 11, and the transfer belt cleaner 16 are consumables subject to wear through repeated image forming operations. The consumables are exchangeably (removably) disposed in the casing 9. For example, each image forming unit 2 (the photoreceptor drum 3, the charger 4, the exposing unit 9, the developer 6, and the photoreceptor cleaner 8) is incorporated in a housing 35 in the form of a cartridge (integrated structure) and is exchangeably disposed in the casing 9 as what is called a process cartridge.

2. First Embodiment of Power Transmission Structure in Image Forming Unit

Figure 2:
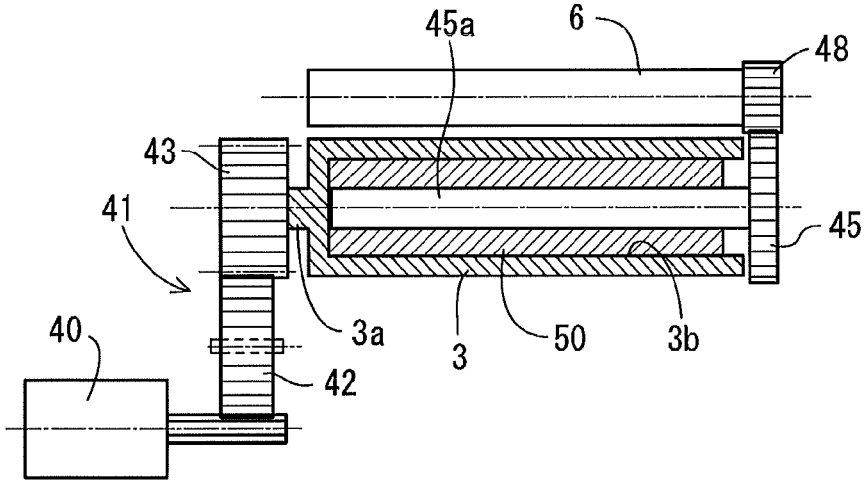
FIG. 2 is a longitudinal sectional view of a power transmission system of an image forming unit according to a first embodiment.

Referring to FIG. 2, a first embodiment of a power transmission structure in the image forming unit 2 will be described below. The printer 1 includes, on a side of the casing 9, a driving motor 40 serving as a driving source to generate power. In the first embodiment, the power generated by the driving motor 40 is transmitted to the photoreceptor drum 3 serving as an image carrier and to the developer 6 (developing roller) serving as a rotator in this order.

In this case, the power generated by the driving motor 40 is first transmitted to an input gear train 41 serving as a first power transmission system. The input gear train 41 includes an input gear 42 and a photoreceptor driving gear 43. The input gear 42 receives the power from the driving motor 40. The photoreceptor driving gear 43 meshes with the input gear 42. The photoreceptor driving gear 43 is secured to a rotary shaft 3*a* protruding outward from the photoreceptor drum 3. This makes the photoreceptor drum 3 integrally rotate with the photoreceptor driving gear 43.

The power transmitted to the photoreceptor drum 3 is transmitted to the developer 6 through an output gear 45 as a second power transmission system. As described in detail below, the output gear 45 rotates in conjunction with the photoreceptor drum 3. The output gear 45 meshes with a developer driving gear 48 that drives the developer 6. The power transmitted to the output gear 45 is transmitted to the developer driving gear 48, thus driving the developer 6.

As shown in FIG. 2, the photoreceptor drum 3 has a cylindrical shape with one end open. The photoreceptor drum 3 has a recess 3*b*, in which a viscoelastic body 50 is disposed to serve as a damper to attenuate oscillations associated with the power transmission and transmitted to the photoreceptor drum 3. Through the viscoelastic body 50 in the recess 3*b*, an output transmission shaft 45*a* is passed, and the output transmission shaft 45*a* is secured to the rotation center of the output gear 45. The viscoelastic body 50 and the output transmission shaft 45*a* are fitted in the recess 3*b* of the photoreceptor drum 3 by press fitting or other means that makes them difficult to fall out. The viscoelastic body 50 couples the photoreceptor drum 3 to the output gear 45 (including the output transmission shaft 45*a*) so as to rotate the output gear 45 in conjunction with the photoreceptor drum 3. The rotary shaft 3*a* protrudes from closed outer surface on the opposite side of the opening of the recess 3*b* in the photoreceptor drum 3. As described above, the photoreceptor driving gear 43 is secured to the rotary shaft 3*a*. Examples of the viscoelastic body 50 include, but not limited to, natural rubber, polybutadiene rubber, chloroprene rubber, and butyl rubber. Other examples of the viscoelastic body 50 include, but not limited to, vulcanized rubber formed by vulcanization, styrene thermoplastic elastomers formed by injection molding, olefin thermoplastic elastomers formed by injection molding, and urethane thermoplastic elastomers formed by injection molding.

When rotating the output gear 45 in conjunction with the photoreceptor drum 3, the rotary force transmitted to the photoreceptor drum 3 is transmitted to the output gear 45 through the viscoelastic body 50 and the output transmission gear 45*a* in the recess 3*b*. This effects a slight relative rotation between the photoreceptor drum 3 and the output gear 45 (that is, a rotation delay of the rotating gear 45 results), due to elastic restoration force of the viscoelastic body 50. When oscillations occur due to, for example, variations in load of the developer 6 and meshing errors, the oscillations are attenuated by the viscoelastic body 50. Specifically, the viscoelastic body 50 attenuates oscillations associated with the power transmission and transmitted to the photoreceptor drum 3, thus minimizing oscillation expansion to the photoreceptor drum 3. This largely reduces varying rotation rates of the photoreceptor drum 3. This, as a result, minimizes image blurring (banding), thereby improving image quality.

With the viscoelastic body 50 disposed in the recess 3*b* of the photoreceptor drum 3, the photoreceptor drum 3 accommodating the viscoelastic body 50 does not occupy much space in the printer 1. This provides compactness of the photoreceptor drum 3 accommodating the viscoelastic body 50 and of the power transmission systems 41 and 45, resulting in a compact image forming unit 2. It is particularly noted that the image forming unit 2 is what is called a process cartridge, which is exchangeable relative to the casing 9, and this provides the added advantage of simplifying the power transmission systems 41 and 45 in structure and reducing them in size and weight.

Figure 3:
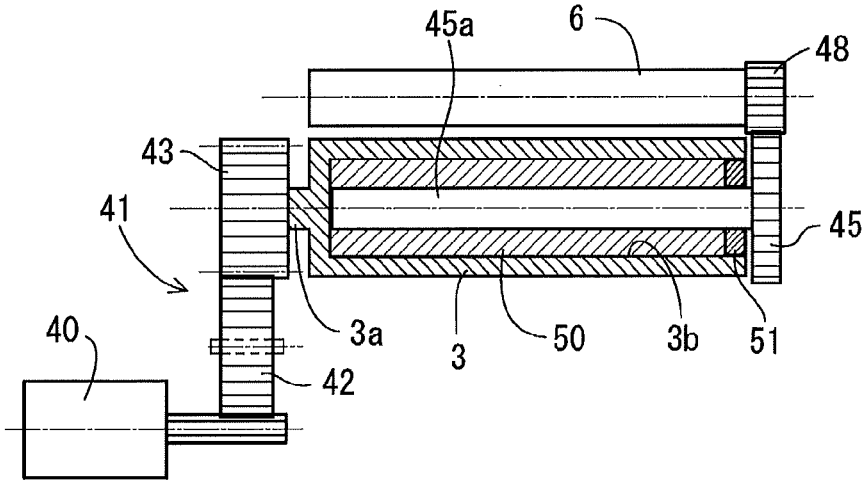
FIG. 3 is a longitudinal sectional view of a first modification of the first embodiment.
Figure 4:
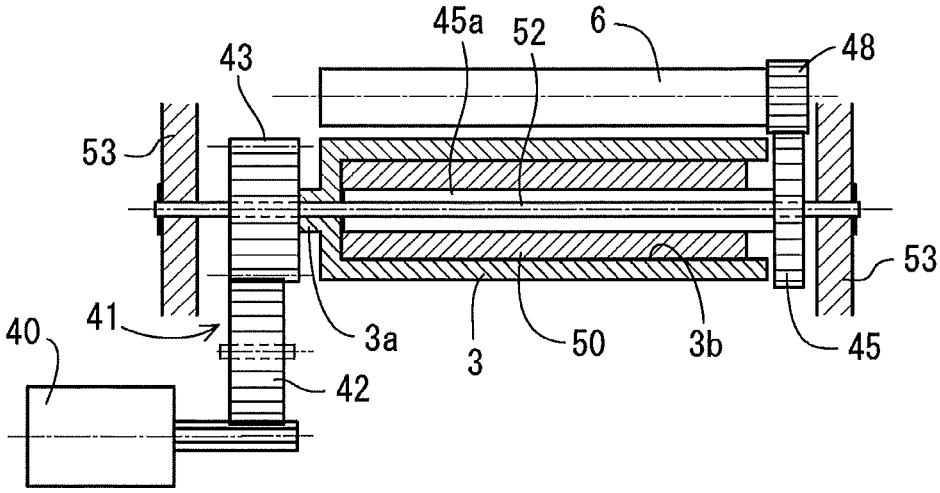
FIG. 4 is a longitudinal sectional view of a second modification of the first embodiment.

FIGS. 3 and 4 show modifications of the first embodiment. As shown in FIG. 3, a first modification is that the opening of the photoreceptor drum 3, which is on the output gear 45 side, is closed by a lid 51. The lid 51 is fitted in the opening of the photoreceptor drum 3 by press fitting or other means that makes the lid 51 difficult to fall off. The output transmission shaft 45*a* of the output gear 45 rotatably penetrates through the center of the lid 51. The lid 51 ensures reliable and facilitated shaft fitting (positioning) of the output transmission shaft 45*a* with respect to the photoreceptor drum 3.

As shown in FIG. 4, a second modification of the first embodiment is that a common penetrating support shaft 52 penetrates through the photoreceptor driving gear 43, the photoreceptor drum 3 (including the rotary shaft 3*a*), and the output gear 45 (including the output transmission shaft 45*a*). The penetrating support shaft 52 pivotably supports the photoreceptor driving gear 43, the photoreceptor drum 3, and the output gear 45. Thus, the penetrating support shaft 52 is positioned on the rotary axis of the photoreceptor driving gear 43, the photoreceptor drum 3, and the output gear 45. The penetrating support shaft 52 is supported at its ends by a pair of side plates 53, which are disposed in the printer 1. The penetrating support shaft 52 ensures reliable and facilitated centering of the photoreceptor driving gear 43, the photoreceptor drum 3, and the output gear 45.

3. Second Embodiment of Power Transmission Structure in Image Forming Unit

Figure 5:
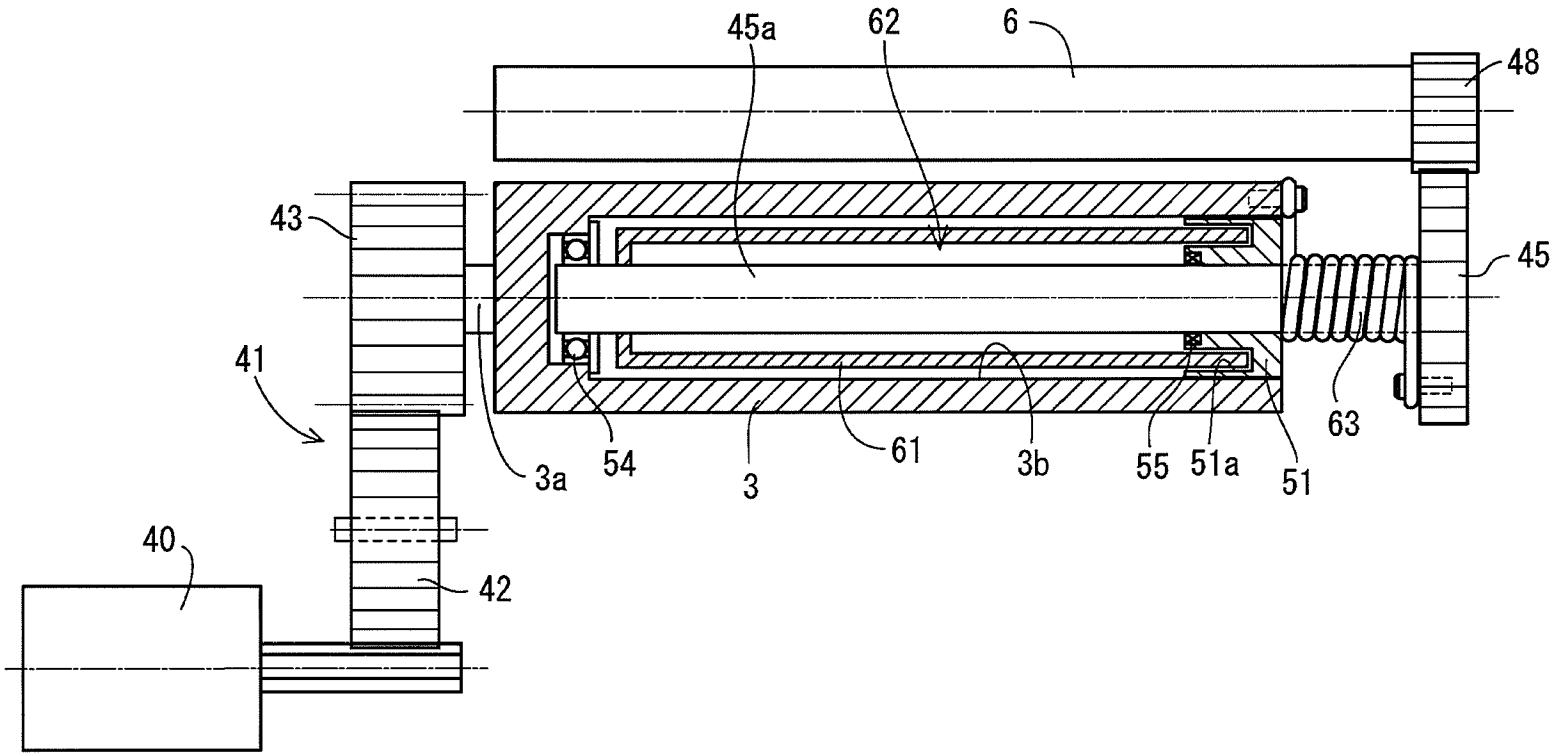
FIG. 5 is a longitudinal sectional view of a power transmission system of an image forming unit according to a second embodiment.

Referring to FIG. 5, a second embodiment of the power transmission structure in the image forming unit 2 will be described below. The second embodiment is different from the first embodiment in that the opening of the photoreceptor drum 3, which is on the output gear 45 side, is closed by the lid 51, and that a damper different from the viscoelastic body 50 is used. Specifically, the damper according to the second embodiment is a combination of a rotating resistor 61, a viscous fluid 62, and a linkage spring 63. The rotating resistor 61 integrally rotates with the output transmission shaft 45*a*. The viscous fluid 62 provides resistance to the rotation of the rotation resistor 61. The linkage spring 63 couples the photoreceptor drum 3 and the output gear 45 to one another in a power transmittable manner.

The output transmission shaft 45*a* at its distal end is rotatably supported by the closed inner surface on the opposite side of the opening of the photoreceptor drum 3 via a shaft bearing 54. At the base end, the output transmission shaft 45*a* is rotatably supported by the lid 51. The linkage spring 63, which serves as an elastic body, covers the portion of the output transmission shaft 45*a* located between the photoreceptor drum 3 and the output gear 45. The linkage spring 63 has one end engaged with the photoreceptor drum 3 and another end engaged with the output gear 45. The photoreceptor drum 3 transmits the rotary force to the output gear 45 utilizing the elastic restoration force of the linkage spring 63.

The viscous fluid 62 provides viscous resistance to the rotation of the resistor 61 when the rotating resistor 61 rotates in conjunction with the photoreceptor drum 3. The viscous resistance causes a slight relative rotation between the rotating resistor 61 and the photoreceptor drum 3 (that is, a rotation delay of the rotating resistor 61 results). The viscous resistance obtained here is attributed to the shear resistance and agitation resistance of the viscous fluid 62. Examples of the viscous fluid 62 include, but not limited to, grease and a highly viscous fluid such as silicone oil.

The rotating resistor 61 has a cylindrical shape with one end open. The lid 51 includes a circular groove 51*a* corresponding to one end opening of the rotating resistor 61. The one end opening of the rotating resistor 61 is inserted in the circular groove 51*a* of the lid 51 with a slight gap left between the circular groove 51*a* of the lid 51 and the one end opening of the rotating resistor 61. The viscous fluid 62 is also disposed in the gap. At the portion of the lid 51 through which the output transmission shaft 45*a* penetrates, an oil seal 55 is disposed to prevent leakage of the inner viscous fluid 62. The second embodiment is otherwise similar to the first embodiment.

When the output gear 45 rotates in conjunction with the photoreceptor drum 3, the rotary force transmitted to the photoreceptor drum 3 is transmitted to the output gear 45 against the elasticity of the linkage spring 63. The rotating resistor 61 in the recess 3*b* of the photoreceptor drum 3 attempts to integrally rotate with the output transmission shaft 45*a* while receiving the viscous resistance of the viscous fluid 62. The viscous resistance of the viscous fluid 62 and the elastic restoration force of the linkage spring 63 cause a slight relative rotation between the photoreceptor drum 3 and the rotating resistor 61, consequently between the photoreceptor drum 3 and the output gear 45 (that is, a rotation delay of the rotating resistor 45 results). When oscillations occur due to, for example, variations in load of the developer 6 and meshing errors, the oscillations are attenuated by the viscous fluid 62 and the linkage spring 63. Specifically, the viscous fluid 62 and the linkage spring 63 attenuate oscillations associated with the power transmission and transmitted to the photoreceptor drum 3, thus minimizing oscillation expansion to the photoreceptor drum 3. This largely reduces varying rotation rates of the photoreceptor drum 3. This, as a result, minimizes image blurring (banding), thereby improving image quality, similarly to the first embodiment.

Figure 6:
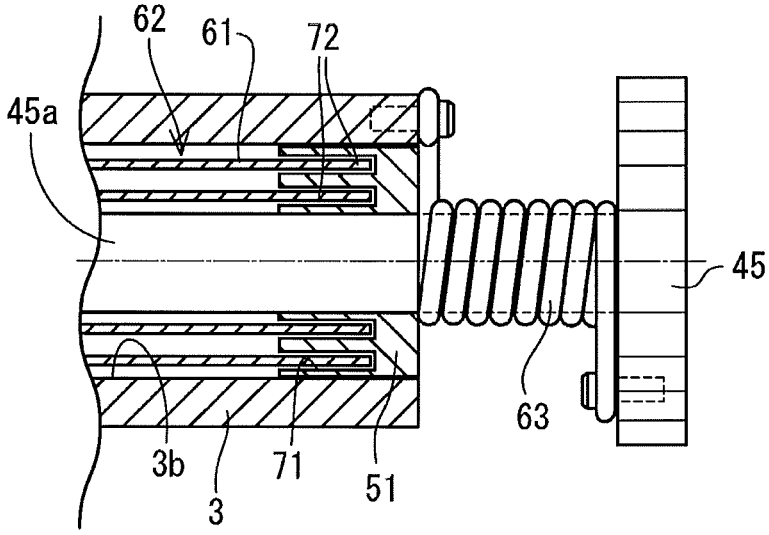
FIG. 6 is a longitudinal sectional view of a first modification of the second embodiment.
Figure 7:
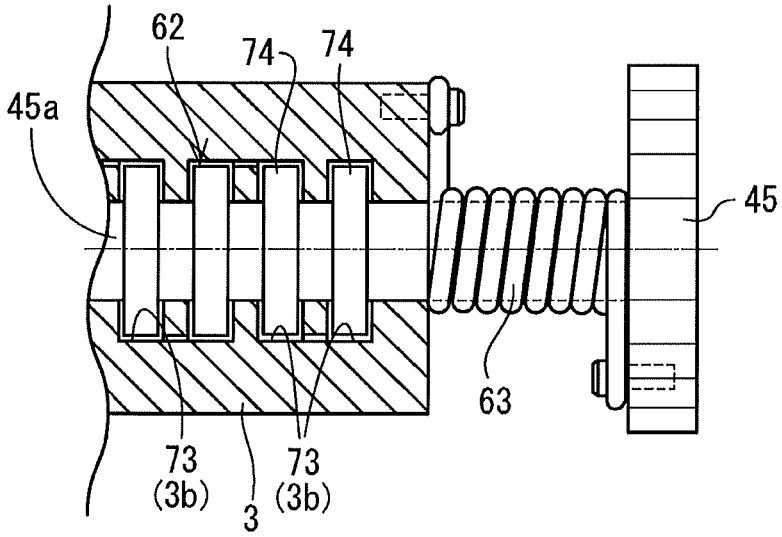
FIG. 7 is a longitudinal sectional view of a second modification of the second embodiment.
Figure 8:
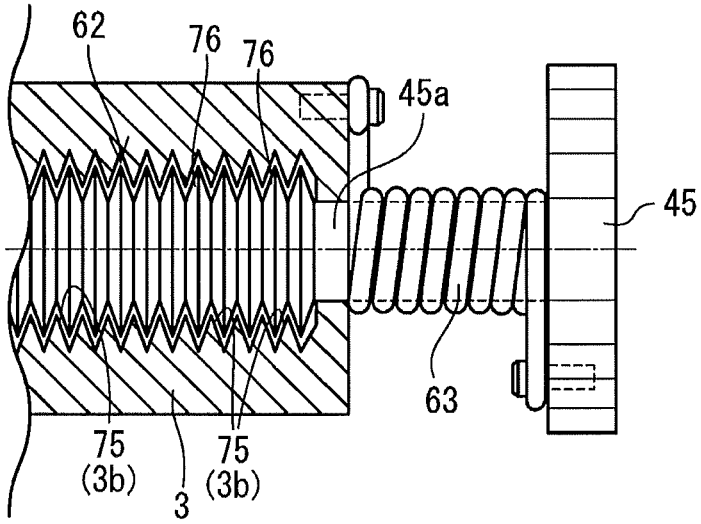
FIG. 8 is a longitudinal sectional view of a third modification of the second embodiment.

FIGS. 6 to 8 show modifications of the second embodiment. As shown in FIG. 6, a first modification of the second embodiment is that the rotating resistor 61 includes a plurality of annular protrusions 72 (that can also be referred to as recesses and protrusions). The annular protrusions 72 are concentrically expand relative to the output transmission shaft 45*a*. The lid 51 includes a plurality of annular protrusions 71 that mesh with the annular protrusions 72 of the rotating resistor 61. In other words, the lid 51 and the rotating resistor 61 each have a comb-shaped cross-section that enables the meshing with other. The annular protrusions 71 and 72 fit each other with slight gaps left between the annular protrusions 71 and 72 (that is, to ensure a loose fit). The viscous fluid 62 is also disposed in the gaps.

This configuration ensures a large area of contact between the viscous fluid 62 and the lid 51 and between the viscous fluid 62 and the rotating resistor 61. This, in turn, improves the function of the viscous fluid 62 providing viscous resistance to the rotation of the output gear 45, and more reliably reduces varying rotation rates of the photoreceptor 13. This, as a result, minimizes image blurring (banding), thereby further improving image quality.

As shown in FIG. 7, a second modification of the second embodiment is that the recess 3*b* of the photoreceptor drum 3 includes a plurality of compartments 73 aligned along the output transmission shaft 45*a*. At the portions of the output transmission shaft 45*a* corresponding to the compartments 73, disk-shaped rotating resistors 74 are disposed to integrally rotate with the output transmission shaft 45*a*. The viscous fluid 62 is disposed in the compartments 73 to move between adjacent compartments 73. The photoreceptor drum 3 is dividable at the rotary shaft 3*a* serving as the center of division. This configuration ensures a large area of contact between the viscous fluid 62 and the compartments 73 in the photoreceptor drum 3 and between the viscous fluid 62 and the rotating resistors 74 in the photoreceptor drum 3. This improves the function of the viscous fluid 62 providing viscous resistance to the rotation of the output gear 45.

As shown in FIG. 8, a third modification is that the recess 3*b* of the photoreceptor drum 3 includes a plurality of fixed ring plates 75 aligned along the output transmission shaft 45*a*. On the output transmission shaft 45*a*, disk-shaped rotating resistors 76 are disposed at appropriate intervals to integrally rotate with the output transmission shaft 45*a*. The fixed ring plates 75 and the rotating resistors 76 are alternately disposed. The viscous fluid 62 is disposed in the void in the recess 3*b*. The photoreceptor drum 3 is dividable at the rotary shaft 3*a* serving as the center of division. This configuration ensures a large area of contact between the viscous fluid 62 and the fixed ring plates 75 and between the viscous fluid 62 and the rotating resistors 76. This improves the function of the viscous fluid 62 providing viscous resistance to the rotation of the output gear 45.

4. Others

The present invention is not limited to the above-described embodiments and can be embodied in various forms. For example, while a printer has been described as an exemplary image forming apparatus, this should not be construed in a limiting sense. Other possible examples include copiers, fax machines, and multi-function machines integrally incorporating copy and fax capabilities. Moreover, the location or arrangement of individual elements in the illustrated embodiments should not be construed in a limiting sense. Various modifications can be made without departing from the scope of the present invention.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An image carrier driver comprising:

an image carrier configured to rotate by power generated by a driving source;

a first power transmitter configured to transmit the power from the driving source to the image carrier;

a rotator disposed further downstream than the image carrier in a flow of power transmission;

a second power transmitter configured to transmit the power from the image carrier to the rotator; and a damper disposed in the image carrier and configured to attenuate an oscillation associated with the power transmission and transmitted from the second power transmitter to the image carrier, wherein the damper operatively connects the image carrier and the second power transmitter so that the damper transmits the power from the image carrier to the second power transmitter.

2. The image carrier driver according to claim 1, wherein the damper comprises a viscoelastic body configured to couple the image carrier to the second power transmitter so as to rotate the second power transmitter in conjunction with the image carrier.

3. The image carrier driver according to claim 1, wherein the damper comprises a rotating resistor configured to rotate in conjunction with the image carrier, a viscous fluid configured to provide resistance to rotation of the rotating resistor, and an elastic body configured to couple the image carrier to the second power transmitter so as to transmit the power from the image carrier to the rotator.

4. An image forming apparatus comprising:

a power source; and an image carrier driver comprising:

an image carrier configured to rotate by power generated by the driving source;

a first power transmitter configured to transmit the power from the driving source to the image carrier;

a rotator disposed further downstream than the image carrier in a flow of power transmission;

a second power transmitter configured to transmit the power from the image carrier to the rotator; and a damper disposed in the image carrier and configured to attenuate an oscillation associated with the power transmission and transmitted from the second power transmitter to the image carrier, wherein the damper operatively connects the image carrier and the second power transmitter so that the damper transmits the power from the image carrier to the second power transmitter.

5. The image forming apparatus according to claim 4, wherein the damper comprises a viscoelastic body configured to couple the image carrier to the second power transmitter so as to rotate the second power transmitter in conjunction with the image carrier.

6. The image forming apparatus according to claim 4, wherein the damper comprises a rotating resistor configured to rotate in conjunction with the image carrier, a viscous fluid configured to provide resistance to rotation of the rotating resistor, and an elastic body configured to couple the image carrier to the second power transmitter so as to transmit the power from the image carrier to the rotator.

7. The image carrier driver according to claim 1, wherein the image carrier possesses a hollow interior, and the damper is connected to the hollow interior of the image carrier.

8. The image forming apparatus according to claim 4, wherein the image carrier possesses a hollow interior, and the damper is connected to the hollow interior of the image carrier.

9. The image carrier driver according to claim 1, wherein the damper possesses opposite axial free ends, with at least one of the axial free ends being housed within the image carrier.

10. The image forming apparatus according to claim 4, wherein the damper possesses opposite axial free ends, with at least one of the axial free ends being housed within the image carrier.

11. The image carrier driver according to claim 1, wherein the entire damper is housed within the image carrier.

12. The image forming apparatus according to claim 4, wherein the entire damper is housed within the image carrier.

13. The image carrier driver according to claim 1, wherein the first power transmitter is connected to the image carrier.

14. The image forming apparatus according to claim 4, wherein the first power transmitter is connected to the image carrier.

15. The image carrier driver according to claim 1, wherein the second power transmitter includes a first portion contacting the rotator and a second portion extending into the image carrier and contacting the damper.

16. The image forming apparatus according to claim 4, wherein the second power transmitter includes a first portion contacting the rotator and a second portion extending into the image carrier and contacting the damper.

* * * * *